United States Patent [19]

Kaufhold et al.

[11] Patent Number: 5,035,338

[45] Date of Patent: Jul. 30, 1991

[54] SLACKLESS RAILCAR CONNECTIONS WITH EXTRACTABLE WEDGE

[75] Inventors: Horst T. Kaufhold, Chicago, Ill.; Russell G. Altherr, Munster, Ind.

[73] Assignee: AMSTED Industries Incorporated, Chicago, Ill.

[21] Appl. No.: 483,876

[22] Filed: Feb. 23, 1990

[51] Int. Cl.[5] ..... B61G 5/02; B61G 7/10

[52] U.S. Cl. ..... 213/50; 213/62 R

[58] Field of Search ..... 213/50, 60, 61, 62 R, 213/62 A, 67 R, 67 A, 64, 74, 56

[56] References Cited

U.S. PATENT DOCUMENTS

| | | | |
|---|---|---|---|
| 373,957 | 11/1887 | Young | 213/56 |
| 1,232,594 | 7/1917 | Newell | 213/56 |
| 1,443,716 | 1/1923 | Pletcher | 213/69 X |
| 1,925,319 | 9/1933 | Goodall | 213/74 |
| 2,241,353 | 5/1941 | Kinne et al. | 213/67 R X |
| 2,307,409 | 1/1943 | Kinne et al. | 213/67 R |
| 2,452,015 | 10/1948 | Kinne et al. | 213/67 R |
| 4,700,854 | 10/1987 | Chadwick | 213/50 X |

*Primary Examiner*—Robert J. Oberleitner
*Assistant Examiner*—S. Joseph Morano
*Attorney, Agent, or Firm*—Edward J. Brosius; F. S. Gregorczyk

[57] ABSTRACT

A gravity wedge shim includes a cavity and aperture at the top thereof and a lifting tool is extended through an opening in a sill ceiling above the wedge, inserted into the aperture and twisted so as to engage the wedge for lifting same.

11 Claims, 2 Drawing Sheets

80
96
10
52
56
54
98
50

4
54
98
96
102
70
12
80
100
50
10

52
12
98
96
80
70
100
54
50
10

SLACKLESS RAILCAR CONNECTIONS WITH EXTRACTABLE WEDGE

This invention relates to the art of slackless railcar connections such as couplers, drawbars, articulated connectors and the like having a gravity wedge component that functions to move so as to fill up space created between other parts due to wear; and more specifically is directed to an improved gravity wedge and method to extract the wedge from between other parts.

BACKGROUND OF THE INVENTION

Connectors for railcars are usually attached to each end of a car underside within a car center sill. A convex end of the connector normally rests against a follower block held within a sill pocket casting that is mounted within the sill to withstand forces tending to thrust the connector into the sill—e.g. compressive or buff loading. Additionally the connector is held against being withdrawn from the sill by a pin or draft key or by a collar which is spaced from the follower block. When the connector is first assembled to the car the clearances between the aforementioned parts are minimal and there is virtually no slack or movement of the parts longitudinal of the car when the forces on the connector are reversed, as occurs each time the car is successively accelerated and decelerated. However, wear occurs through use causing spaces to be created between the parts. Such spaces are known as slack and the cumulative effect will be to repeat and magnify impact forces upon acceleration and deceleration. One cure for this problem has been to include a gravity wedge shim between two of the parts, usually between the follower block and the closed end of the sill pocket casting as shown in U.S. Pat. Nos. 3,716,146, 4,456,133, 4,549,666 and 4,593,829. Other examples of the use of wedges in railcar connections are U.S. Pat. Nos. 373,957, 1,443,716 and 1,925,319.

One or both of the adjacent surfaces of the follower block and/or the pocket casting are sloped to correspond to the wedge. The result is that as wear occurs between various connection parts, the space between follower block and pocket casting will tend to increase and the wedge will move downward by gravity to separate the adjacent parts sufficiently to take up the slack. However, at some point the wear may exceed the ability of the wedge to compensate, and it must be replaced or augmented.

Moreover when first assembling such a railcar connection the gravity wedge must be temporarily manipulated upwardly to create sufficient slack so as to permit the other parts to be aligned. Also there are occasions when connectors must be disassembled from railcars to permit maintenance. At such times the wedge must be withdrawn from between the adjacent parts to create sufficient slack to enable the parts to be removed from the sill. But heretofore these procedures have required the insertion of tools through ports in the bottom or sides of the sill and/or pocket casting to engage and push upward on the wedge.

BRIEF SUMMARY OF THE INVENTION

Accordingly, it is a principal object of the present invention to provide an improved method for extracting a wedge shim from railcar connectors.

It is another object of the present invention to provide a railcar connector gravity wedge shim that is engageable at the top so as to be upwardly extractable from a location above the shim.

It is still another object of the present invention to provide an improved method and apparatus for upwardly extracting a railcar connector gravity wedge shim from a location above the wedge shim.

Briefly stated the present invention involves the inclusion of an engaging means at the broad upper edge of a gravity wedge which engaging means is accessible from an opening thereabove; and inserting a lifting means through the opening into contact with the engaging means and thereafter pulling the gravity wedge upwardly. The present invention is particularly suitable for railcars having articulated connectors or exposed center sill top surface.

BRIEF DESCRIPTION OF THE DRAWINGS

Other objects and advantages of the invention will become apparent upon reading the following detailed description in conjunction with the drawings wherein.

DETAILED DESCRIPTION OF THE INVENTION

Figure 1:
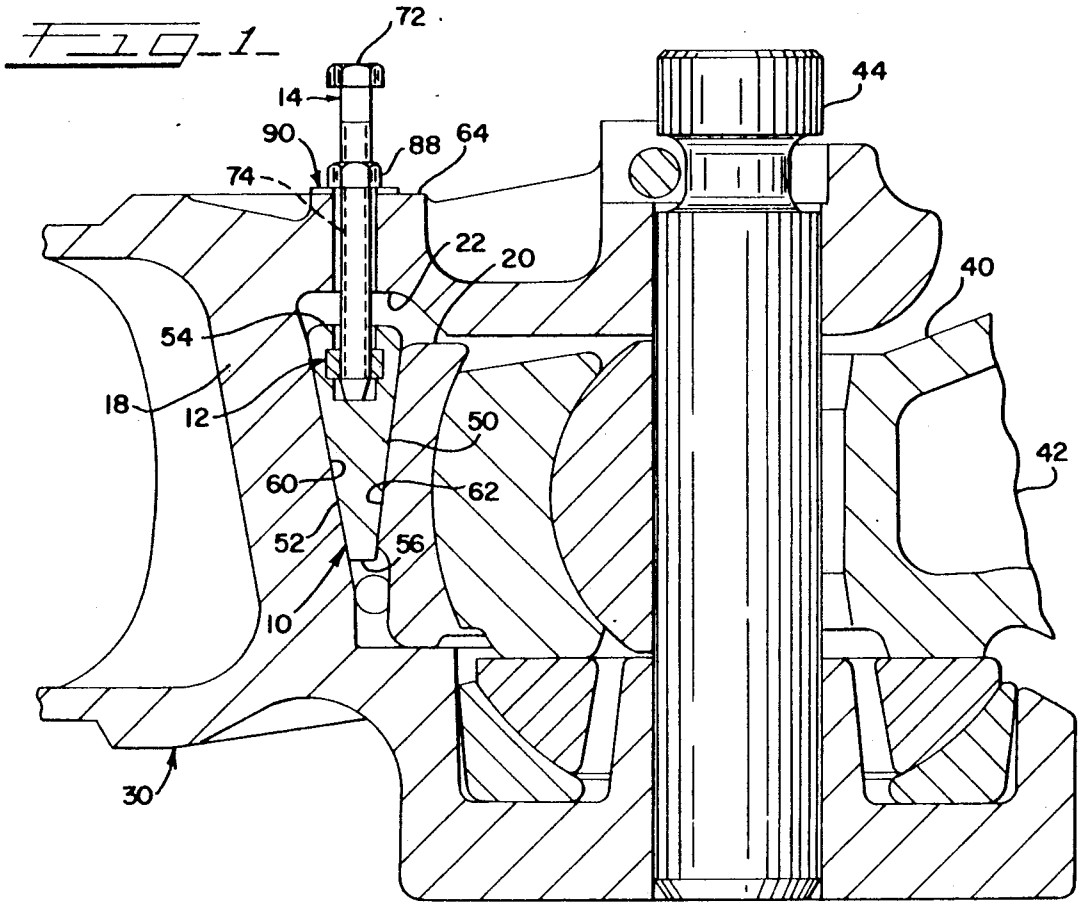
FIG. 1 is a sectional side elevation view of an articulated connector embodiment with a wedge shim of the present invention.

The present invention is applicable to slackless railcar connectors in which the portion of a car frame structure that receives a male end of a connecting member is accessible at the car end, such as articulated car connectors as shown in U.S. Pat. No. 3,716,146 and illustrated in FIG. 1 herein. It is also readily applicable to slackless connectors in railcars that have a center sill portion that extends openly beyond the load container structure of the car, such as the sloped bulkhead of a hopper car, and in other types of railcars where it is possible to locate an access point in the top of a center sill above a gravity wedge.

According to the present invention a gravity wedge shim generally 10 is provided with an engaging means generally 12 at the top edge of the shim which engaging means is adopted to secure and release a lifting means generally 14 that is manually extended from above the shim into contact with the engaging means. Such a gravity wedge shim is normally located within a sill pocket between a pocket rear wall 18 and a bearing block 20 and it is essential to the present invention that the sill pocket ceiling 22 directly above the shim has an aperture 64 that is accessible from overhead.

The present method is practiced by an operator first inserting the lifting means, which is preferably threaded, and contacting the engaging means, which is also preferably threaded, therewith; and thereafter manipulating the lifting means for securing it to the engaging means, as by turning the lifting means whereby the threads thereon mate with threads on the engaging means. The operator then proceeds by pulling upwardly on the lifting means and thereby extracting the wedge shim upwardly from between the pocket rear wall and bearing block. When the wedge shim is extracted sufficiently, the operator may disassemble and- /or service adjacent parts by maintaining the wedge shim in any suitable upward location such as by locking the lifting means against movement relative to the sill pocket ceiling. Thereafter the foregoing steps are reversed to return the wedge shim to an operative position as by unlocking the lifting means and lowering the wedge shim; and then releasing the engaging means and finally withdrawing the lifting means.

A preferred embodiment and application of the present invention is shown in FIGS. 1–4. In FIG. 1, showing an articulated connection, a gravity wedge shim generally 10 is located between pocket rear wall 18 of a female stub sill generally 30 and a follower block 20 that in turn receives the butt end 40 of a male connector 42 that is pivotable about a vertical pin 44 retained in the stub sill 30. As is usual with slackless type connectors, the gravity wedge shim 10 has front and rear faces 50, 52, respectively, which define a body that tapers from a relatively broad top surface or edge 54 to a relatively narrow bottom surface or edge 56; and one or both of the pocket rear wall 18 and follower block 20 have bearing surfaces that are angled vertically so as to receive the wedge 10 upright pointing downwardly.

Figure 3:
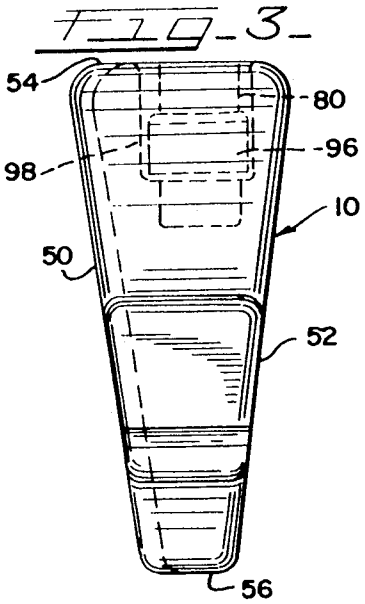
FIG. 3 is a detailed side elevation view of the wedge shim of FIG. 2.
Figure 2:
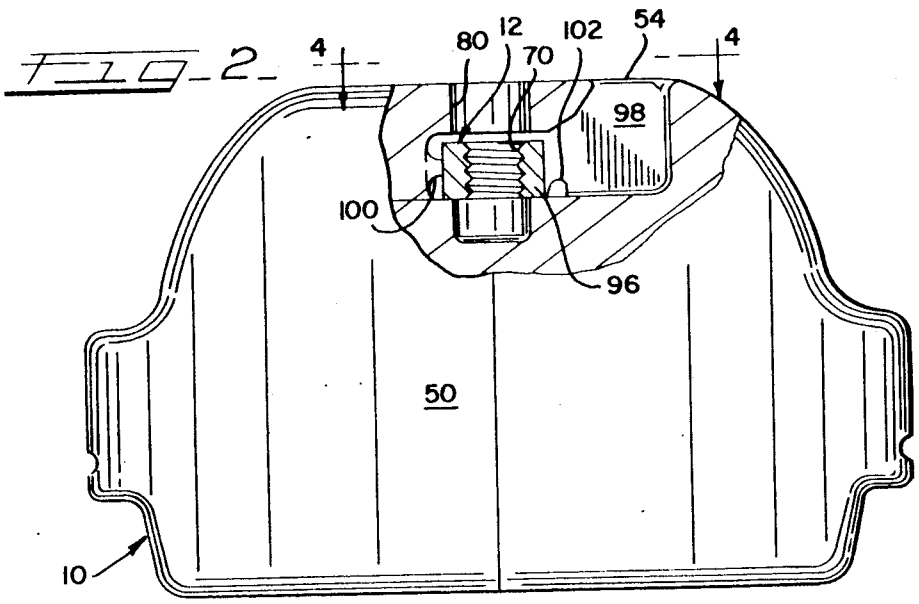
FIG. 2 is an elevation view of a wedge shim according to the present invention showing certain detail in partial section.
Figure 4:
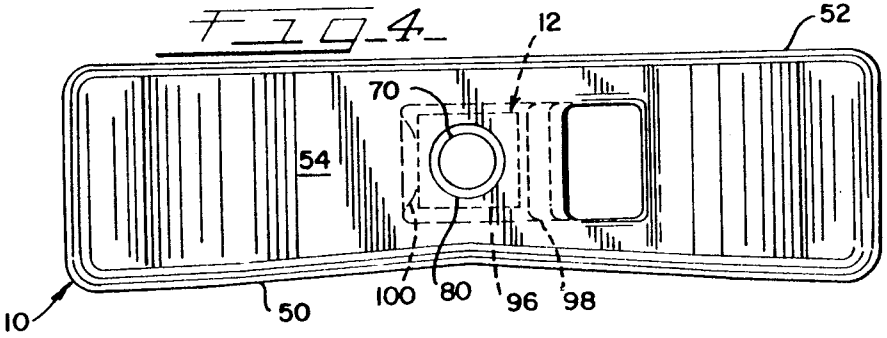
FIG. 4 is a top plan view of the wedge shim of FIG. 2.

As shown in FIG. 1, the pocket rear wall 18 has a bearing surface 60 that is congruent to the rear face 52 of wedge shim 10 and follower block 20 has a bearing surface 62 that is congruent with the front face 50 of wedge shim 10. The wedge front and rear faces 50, 52 may be flat or complex surfaces according to the design details chosen for the connection. Accordingly the abutting bearing surfaces 60, 6 of the pocket rear wall 18 and follower block 20 are flat or complex so as to be congruent with the wedge 10. As best seen in FIGS. 3 and 4 the gravity shim 10 of the illustrated embodiment has a flat rear face 52 which abuts a flat bearing surface 60 on pocket rear wall 18 and a concave front face 50 which abuts a congruent convex bearing surface 62 on the follower block 20. It will be seen that the gravity wedge front face 50 is comprised of two portions symmetrically angled, chevron-like, from a vertical center plane which is believed to hinder rotation of the wedge shim 10 and promote alignment with the follower block 20.

According to the present invention, an engaging means generally 12 is located at the top 54 of the wedge shim 10 so as to be readily secured and released by a lifting member 14 insertable through a small opening 64 in the sill pocket ceiling 22. The engaging means generally 12 may include a cavity and aperture for releasably receiving a lifting tool. In the embodiment illustrated the engaging means 12 is in the form of internal threads 70 that are positioned centrally of the wedge top surface 54; and the lifting tool or member 14, seen only in FIG. 1, is an externally threaded bolt 72 having a threaded end 74 engageable with the internal threads of the engaging means 12.

The preferred wedge shim 10 has a central aperture or bore 80 within which the internal threads 70 are located. Bore 80 is of sufficient diameter to freely receive the bolt 72 and extends to a sufficient depth to permit the bolt threads to securely engage the internal threads 70.

The opening 64 in sill pocket ceiling 22 is located directly above the wedge shim 10 so that the bolt 72 may be inserted to engage the wedge shim 10 and also be withdrawn therefrom. Preferably the hole 64 is of sufficient horizontal dimension to allow for some longitudinal movement of the wedge shim and is closed by a removable plug (not shown) when the bolt 72 is removed. A vertical positioning means or locking means is also preferably associated with the lifting member 14. Where the latter is in the form of a threaded bolt 72, as illustrated in FIG. 1, the positioning means may conveniently take the form of a retaining nut 88 spaced from the bolt threaded end 74 which nut may be screwed along the bolt threads so as to engage the top of the stub sill 30. A washer 90 may be interposed between the retaining nut 88 and top of the sill if needed to bridge the hole 64.

Preferably the wedge shim 10 is provided with a captive nut 96, secured against rotation in bore 80. Where the wedge shim 10 is a casting, it is possible to mold a rectangular cavity 98 intersecting with the bore 80 and the cavity having an offset opening to the wedge top surface 54 through which the captive nut 96 may be inserted across the bore 80. In the construction illustrated in FIGS. 2–4, the nut 96 closely fits into the cavity and has a side shaped to receive a small lug 100 formed in the cavity end whereby to align the internal threads of the nut with the bore 80 and to prevent rotation of the captive nut 96. A small spot weld 102 is placed in the cavity at the opposite side of the captive nut 96 to prevent its removal from the wedge shim 10.

Modifications and variations may be made in the aforedescribed invention without departing from the spirit and scope thereof which is defined hereafter in the claims.

What is claimed is:

1. A method for extracting and replacing a gravity wedge respecting an operating position between two parts of a slackless railcar connection, located within a carbody sill structure, said method comprising:

providing an engaging means at the upper end of said wedge;

inserting a lifting means through an opening provided in the ceiling of said carbody sill toward said engaging means;

securing said lifting means to said engaging means by contacting said engaging means with said lifting means and manipulating said lifting means so as to become fastened thereto;

pulling upwardly on said lifting means whereby to extract said wedge from between said two parts to an upward location;

holding said wedge at said upward location;

lowering said wedge from said upward location to said operating position; and releasing said lifting means from said engaging means.

2. The method of claim 1 wherein said lifting means is inserted into said wedge and manipulated by turning in a first direction so as to become secured to said engaging means.

3. The method of claim 2 wherein said step of releasing said lifting means includes turning said lifting means in an opposite direction so as to disengage and withdrawing said lifting means from said engaging means and from said opening.

4. The method of claim 1 wherein said step of holding said wedge includes locking said lifting means against downward movement with respect to said opening.

5. An improved gravity wedge for a slackless railcar connection said wedge having a tapered body extending from a relatively broad top surface to a relatively narrow bottom surface for placement in an operative position where it descends by gravity between two parts of a slackless railcar connection, said improvement comprising:

an engaging means located at the top of said wedge body whereby to releasably secure said wedge to means for lifting said wedge, said engaging means being a member positioned within a cavity in said wedge body beneath an aperture extending from said top surface into said cavity.

6. The device of claim 5 wherein said engaging means is positioned centrally of the top of said wedge.

7. The device of claim 5 wherein said engaging means includes threads.

8. The device of claim 5 including a central bore extending into said tapered body from said top surface, a cavity formed in said body to intersect with said bore below said top surface, said cavity having an opening to said top surface offset from said bore and an internally threaded nut positioned in said cavity and aligned with said bore.

9. The device of claim 8 including a lug in said cavity to properly align said nut with said bore and a spot weld in said cavity to prevent removal of said nut through said offset opening.

10. An improved gravity wedge for slackless railcar connections, said wedge having a tapered body extending from a relatively broad top surface to a relatively narrow bottom surface for placement in an operative position where it will descend by gravity between two parts of a slackless railcar connection, said improvement comprising:

a cavity formed in said body beneath said top surface to cooperate with a releaseable lifting means insertable to said cavity, an aperture centrally of said top surface extending to said cavity and an opening extending from said cavity to a location on said top surface offset from said aperture.

11. The device of claim 10 including an engaging member held within said cavity beneath said aperture to releasably receive a means for lifting said wedge.

* * * * *